US011820627B2

(12) United States Patent
Biagiotti

(10) Patent No.: US 11,820,627 B2
(45) Date of Patent: Nov. 21, 2023

(54) TUBULAR CORE FOR TISSUE PAPER ROLLS AND METHOD FOR THE PRODUCTION OF SUCH A TUBULAR CORE

(71) Applicant: Guglielmo Biagiotti, Capannori (IT)

(72) Inventor: Guglielmo Biagiotti, Capannori (IT)

( * ) Notice: Subject to any disclaimer, the term of this patent is extended or adjusted under 35 U.S.C. 154(b) by 1111 days.

(21) Appl. No.: 16/491,902

(22) PCT Filed: Mar. 7, 2018

(86) PCT No.: PCT/IB2018/051473
§ 371 (c)(1),
(2) Date: Sep. 6, 2019

(87) PCT Pub. No.: WO2018/163080
PCT Pub. Date: Sep. 13, 2018

(65) Prior Publication Data

US 2020/0071121 A1 Mar. 5, 2020

(30) Foreign Application Priority Data

Mar. 7, 2017 (IT) ..... 102017000025090

(51) Int. Cl.
*B65H 75/50* (2006.01)
*B65H 75/10* (2006.01)

(52) U.S. Cl.
CPC ..... *B65H 75/50* (2013.01); *B65H 75/10* (2013.01); *B65H 2701/5112* (2013.01)

(58) Field of Classification Search
CPC . B65H 75/50; B65H 2701/5112; B65H 75/10
See application file for complete search history.

(56) References Cited

U.S. PATENT DOCUMENTS 2,755,821 A * 7/1956 Stahl ..... F16L 9/16 493/299
3,338,270 A * 8/1967 Denenberg ..... B29C 53/60 156/193

(Continued)

FOREIGN PATENT DOCUMENTS

WO 2009007551 1/2009

OTHER PUBLICATIONS

International Search Report dated Jun. 6, 2018.

(Continued)

*Primary Examiner* — Anna K Kinsaul
*Assistant Examiner* — Himchan Song
(74) *Attorney, Agent, or Firm* — Preston Smirman; SMIRMAN IP LAW, PLLC

(57) ABSTRACT

The tubular core (1) for tissue paper rolls consists of at least one tape (10) of tissue paper with one or more spirally wound tapes, such that the pitch of the winding helix is much smaller than the width of the tape (10) itself, so that two consecutive coils (S) are partially overlapped. In the tubular core (1) there may be several tissue paper tapes (10) wound simultaneously in relative helical coils preferably offset along the longitudinal axis of the same tubular core (1). The coils (S) of each tape (10), in the areas in which they are partially overlapped, are mutually fixed by means of an adhesive film (2) interposed between them. The adhesive film (2) is preferably continuous according to the winding direction of the coils (S) themselves. The presence of said adhesive films (2) produces a solid connection between the helical coils (S) and confers the necessary structural resistance to the tubular core (1) to receive, for wrapping on it, a tissue paper roll for hygienic use or domestic or other tape material.

10 Claims, 4 Drawing Sheets

(56) References Cited

U.S. PATENT DOCUMENTS

| | | | | |
|---|---|---|---|---|
| 4,026,690 | A * | 5/1977 | McClellan | B65H 75/50 428/172 |
| 5,671,897 | A * | 9/1997 | Ogg | B65H 75/10 138/144 |
| 2003/0034117 | A1 | 2/2003 | Scott et al. | |
| 2009/0075001 | A1 | 3/2009 | O'Neill | |
| 2011/0287273 | A1 | 11/2011 | Weisang et al. | |
| 2014/0230950 | A1* | 8/2014 | Mellin | B31C 3/00 138/177 |
| 2015/0122938 | A1* | 5/2015 | Walgenwitz | B65H 75/10 242/600 |
| 2016/0144590 | A1 | 5/2016 | Roesch et al. | |
| 2017/0361563 | A1* | 12/2017 | Cattacin | B65H 18/28 |

OTHER PUBLICATIONS

Written Opinion of International Searching Authority dated Jun. 6, 2018.

International Preliminary Report on Patentability dated Sep. 10, 2019.

* cited by examiner

TUBULAR CORE FOR TISSUE PAPER ROLLS AND METHOD FOR THE PRODUCTION OF SUCH A TUBULAR CORE

CROSS-REFERENCE TO RELATED APPLICATION

The instant application is a national phase of PCT International Application No. PCT/IB2018/051473, filed Mar. 7, 2018, and claims priority to Italian Patent Application Serial No. 102017000025090, filed Mar. 7, 2017, the entire specifications of both of which are expressly incorporated herein by reference.

TECHNICAL FIELD

The invention belongs to the technical sector of the paper industry, with particular reference to the production of the tubular cores on which the tissue paper rolls, non-woven fabric or other tape material are wound.

STATE OF THE ART

As is known, such cores are preferably made of cardboard, by known machines such as tubing or tube-forming machines, known per se, which wind in coil one or more tapes of said cardboard around a metal spindle, so as to form a continuous pipe.

At the outlet, the tube is cut to the size corresponding to the width of the tissue paper rolls that will have to be wound around and is then fed to a rewinder which forms the rolls of the width of the paper roll.

After winding the rolls around the relative tubular cores, these are further axially sectioned to obtain the rolls on the size suitable for commercialization.

The choice of the cardboard for the realization of tubular cores is due to the need to reconcile a good mechanical resistance with a low cost of the raw material and with an easy disposal and recycling of the same material when the tissue paper roll has been completely used.

Although it is called paper material tubular core, then disposable together with the paper, it is not possible to throw it in the toilet because it would surely clog the sewer drains.

The cardboard, in fact, absorbs water much more slowly than tissue paper, so it takes a much longer time to disintegrate.

So, unlike tissue paper that can be disposed of directly through sewers, relying on its rapid disintegration, cardboard cores should follow the normal procedure for the disposal of other solid waste, namely the separate collection, the withdrawal by means of the garbage disposal of the paper bins, the transfer to the clearing centers and so on.

We understand how the problem, considered in its global dimension, is anything but negligible, both in terms of costs and environmental impact.

To overcome this drawback it would also be desirable to have the tubular core in tissue paper, but the technical problem to be overcome is to give such a core the necessary mechanical resistance to both axial and radial stresses.

International application WO2009/007551 describes a tubular core made of tissue paper and a method for obtaining it.

Said core is constituted by at least one tape of tissue paper, at least locally impregnated with starch, which is wound in a spiral according to the conventional technique of making the tubular cores in cardboard, that is to say by placing the coils exactly one next to the other thanks to the fact that the pitch of the winding is exactly equal to the width of the tape being wound; starch is entrusted with the function of increasing the structural rigidity of the core itself.

In order for the tissue tape which is wound in a spiral to have the required consistency and rigidity, a peculiar method of embodiment is provided which provides for:

- coupling two tapes of tissue paper, with one or more plies, interposing a layer of adhesive between them;
- coupling to the first two tapes additional tapes to one or more plies, interposing respective layers of adhesive, until the desired total number of plies and the desired consistency and stiffness is achieved.

The adhesive interposed between the plies consists of potato starch or a mixture of potato starch, polyvinyl alcohol and polyethylene glycol.

Considering reliable the results in terms of mechanical strength of the tubular core obtained according to the described prior method, shown in the description of said document and compared with those of a conventional cardboard core, it can be deduced that a satisfactory result can be reached.

Further patent documents describing tubular cores made of tissue with production methods similar to that described above are for example the US applications US 2016/0144590 and US 2011/0287273. Also in these documents, tissue paper tapes are made of two or more overlapped plies impregnated and joined by means of an adhesive preferably made of cellulose starch. Subsequently, the obtained paper tapes, which have a thickness and a consistency similar to those of the cardboard, are spirally wound in the manner conventionally used to produce tubular cores starting from cardboard tapes. More specifically, they are wound in a helix around a metal spindle with the coils which remain arranged one next to the other in succession. The coils are connected to each other with tapes of adhesive or by winding in a helix on the first tape a further tape with the same pitch but with the helix principle offset with respect to the first so that the second tape covers the seam line of the coils of the underlying tape. In both cardboard cores and conventional tissue cores obtained with the methods of the documents cited above, the coils wound in a helix of a tape are necessarily adjacent one next to another and can not be overlapped due to the high thickness and stiffness of the tape which would cause wrinkles and/or creases in the wound material and therefore a non-usable product and/or machine jams.

Furthermore, the implementation of the methods outlined above determines the need of operative pitchs as well as specific machines with which to obtain tapes formed by a large number of plies, before being able to use them in forming the tubes.

Moreover, the tubular cores formed in this way, although they are made of tissue, are no longer unrollable, so it is not possible to use the paper as an additional amount of toilet paper or kitchen paper as they would in any case be rigid and of very limited surface.

It is easy to understand how these limitations constitute a negative aspect in terms of production speed, ease of use, as well as the cost of the machinery needed to make the tape with more plies.

SUMMARY OF THE INVENTION

The object of the present invention is therefore to provide tubular cores for tissue paper rolls, made of tissue paper similar to that intended to be wrapped around it.

Another object of the invention is to provide tubular cores made of tissue paper similar to that intended to be wrapped around it, which can be produced by using simple and inexpensive machines specifically designed for the production of continuous tubular cores.

Another object of the invention is to propose a method for producing tubular cores of tissue paper similar to that intended to be wrapped around it, suitable for eliminating the preliminary pitchs provided for in the known art method for preparing tapes of tissue paper with a high number of plies.

Another object of the invention is to provide tubular cores made of tissue paper which have a mechanical resistance suitable for the use which must be made and homogeneous in each area thereof, using appropriate adhesive quantities.

A further object of the invention is to be able to modify the mechanical characteristics of the tissue tubular cores obtained without this leading to significant variations in production times and costs.

Still another object of the invention is to propose a tubular core which allows, once the tissue paper of the roll wound above the tubular core is exhausted, the use of the tissue paper of which the latter is composed for uses similar to those of the paper of the roll.

Another object of the invention is to allow the tubular cores to be disposed of, as they are or used for some use, even through the toilet discharge, like the tissue paper of the roll.

A further object of the invention is to propose a method for the production of tubular tissue cores which has an extremely high efficiency.

Another object of the invention is to propose a method which can reduce the need for staff present around the machines for their management.

Another object of the invention is to propose a method which is able to reduce the production costs of the rolls connected to the wear of the circular knives conventionally used for cutting the rolls wound in rolls of commercial width.

These and other objects are obtained by means of a tubular core for wrapping tissue paper rolls or other tape material consisting of:

- at least one tape of tissue paper with one or more plies wound in a spiral, such that the pitch of the winding helix is much smaller than the width of the tape so that in a generic section perpendicular to the axis of said tubular core a is superposed predetermined number greater than or equal to three of coils of said tape,
- an adhesive wound in a spiral with said tape so as to be interposed between each pair of subsequent partially overlapping coils of said tape, said adhesive film being intended to connect said coils and to contribute to guarantee the necessary structural strength of said tubular core.

A tubular tissue core as described above is particularly economical and advantageous since, once the use of the tape material wound therein is terminated, it can be used by unwinding it in such a way as to obtain a tissue sheet of a high surface and sufficiently soft to allow the traditionally intended uses of tissue paper.

The above objects are also achieved by means of a method for making tubular cores for tissue paper rolls, in which it is provided:

- the unwinding of at least one tissue paper reel;
- the winding on a spindle of the tissue paper tape unwound from said reel, with this winding performed according to a helix spiral of a pitch such that each coil in formation overlaps the previous one for a width proportional to a sub-multiple of the overall one of the tape itself;
- the application of an adhesive film on one side of the tape, in which such adhesive application occurs between said unwinding from the reel and the winding on the spindle, and wherein the adhesive application is provided for distributing the film of adhesive substantially uniformly over a predetermined portion of the tape width which is intended to overlap the previous coil or be overlapped by a subsequent coil.

BRIEF DESCRIPTION OF THE DRAWINGS

The characteristics of the invention will be clear from the following description of preferred embodiments of the method for making tubular cores for tissue paper rolls and tubular core made with this method, referred to in the object, according to what it is stated in the claims and with the aid of the attached drawings, in which:

DESCRIPTION OF THE PREFERRED EMBODIMENTS

Figures 1, 2:
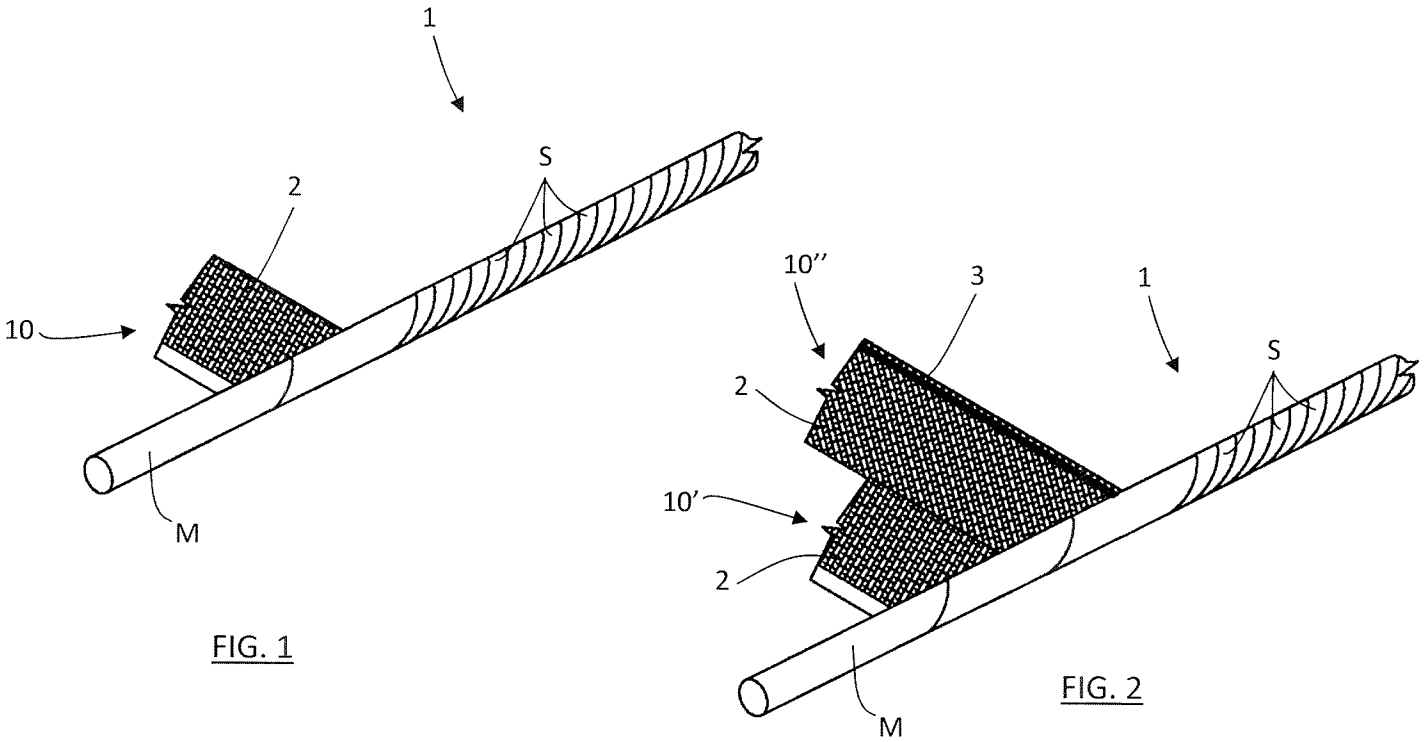
FIG. 1 shows schematically, in an axonometric view, a first type of tubular tissue paper core being formed around a spindle, according to the method in question.
FIG. 2 shows, in a view similar to FIG. 1, a second type of tubular core being formed according to the same method.

In above said figures, it has been indicated with the reference 1 a tubular tissue paper core object of the invention, as a whole.

The tubular core 1, as already mentioned in the introduction, is intended to constitute the central core on which tissue paper rolls for domestic or industrial use, not illustrated, are wound.

According to the invention, the tubular core 1 consists of at least one tissue paper tape 10 with one or more spirally wound plies, such that the pitch of the winding helix is much smaller than the width of the tape 10 itself (FIG. 1) so that in a generic section perpendicular to the axis of said tubular core 1 a number of coils S of said tissue paper greater than or equal to three depending on the width value of the tape 10 and on the pitch value of the helix.

Between each successive pair of coils S is interposed an adhesive film 2, distributed in a substantially uniform manner over almost the entire portion of the tape width which is overlapped.

Preferably, the adhesive film 2 is continuous according to the winding direction, therefore it also assumes, in the tubular core 1, a helical spiral shape, so as to connect said coils S one on the other, making them practically a single body, thereby decisively contributing to guaranteeing the necessary structural strength of said tubular core 1.

According to the pitch chosen for the winding coil of the coils S, there will be a greater or lesser number of the latter which are overlapped in a generic section perpendicular to the axis of said tubular core 1.

By decreasing the value of the pitch of the helix and consequently obtaining a greater number of coils S per unit length of the tubular core 1, there will be an increase in the structural strength of the latter.

The number of overlapped coils is included in a range between 3 and 200 and for a tissue paper roll for domestic use it is preferably between 10 and 30 to make the costs of said tube comparable with those of the cardboard tubes.

It should be noted that a tape of multi-ply tissue paper destined for the formation of tubular cores according to the present invention can be provided by providing various means for coupling the plies, which go from simple gluing of smooth plies to the use of methods known to those skilled in the art such as gluing techniques tip/tip or tip/blank or tip against smooth plie.

In a variant embodiment of the tubular core 1 it is envisaged to use a plurality of tissue paper tapes 10 (two in the non-limiting example of FIG. 2), with each tape 10, wound in a spiral according to a helix pitch much smaller than its width, more precisely proportional to a submultiple of it.

Advantageously, each tape 10 is wound on the previous one so that the relative coils S are offset along the longitudinal axis of said tubular core 1 by a predetermined amount.

In FIG. 2 there are shown two tapes, respectively first 10' and second 10", with the second tape 10" overlapping the first near the end of its width.

On the inner surface of each tape 10', 10", in which the inner surface is intended more precisely the one to become the inner surface of the relative coil wound on the spindle M, a relative adhesive film 2 is applied in a suitable position (FIG. 2), with a width equal to the portion of the width which is overlapped on the previous coil and which consequently does not get into contact with the spindle M.

In the advantageous embodiment illustrated, it is provided that the second tape 10" is furtherly provided with a narrow adhesive tape 3, in which the amount of adhesive is greater than the remaining parts of the adhesive film 2, placed in correspondence of the closing edge, so as to improve the fastening of the same on the underlying coils. It should be noted that said narrow adhesive tape 3 could also be present in the embodiment variant with a single wound tape or may not be provided at all. In the case of several tapes, as a further variant, it is possible to provide that in the second tape 10" the adhesive film 2 is full-width since the second tape 10" never gets into direct contact with any portion of the spindle M.

In further embodiments of the tubular core 1 (not shown), it is envisaged to use several tapes 10, each wound on the previous one similarly to the embodiment example of FIG. 2 in which the second tape 10" is wound on the first tape 10'.

The adhesive film 2 of each tape 10 subsequent to the first one is advantageously of a width equal to the width of the tape itself.

Figure 3:
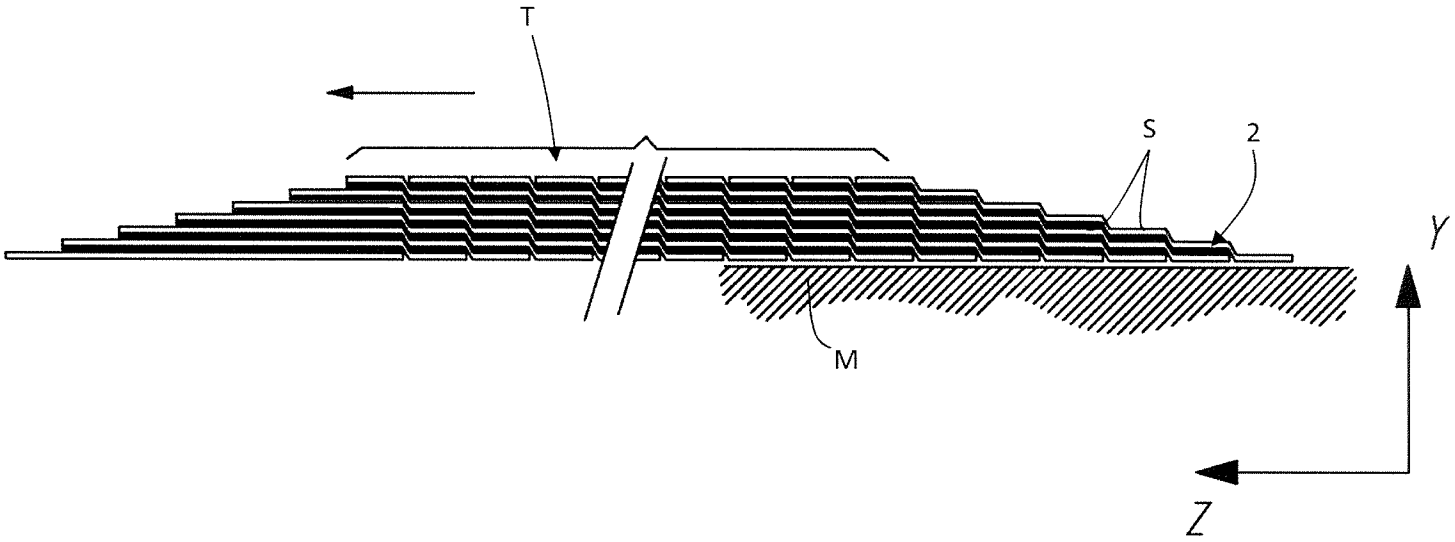
FIG. 3 illustrates, in a greatly enlarged scale, a detail view in longitudinal section of a tubular core according to the invention being formed on a spindle, to highlight the overlapping of the tissue paper coils on the spindle itself.

FIG. 3 shows a sectional view of a tube formed by a tape which overlaps 6 times, so as to show how the progressive wrapping of the tissue paper tape 10 on a spindle M (also shown in FIGS. 1 and 2 and of which will say further below) determine the increase in thickness of the tubular core 1 in formation as a continuous pipe.

The latter extends axially in the direction indicated by the arrow Z in the same FIG. 3, until it emerges from the spindle M itself. In the example of FIG. 3 the tube is formed by seven coils so that the tape is covered for six sevenths of its width of adhesive film 2 and for the same width surmounted by the next coil, while it is free from adhesive and in contact with the spindle M for the remaining seventh of its width.

It is very important to underline that the original technical solution which envisages to partially overcome the helical coils S of each tape 10, both for the variant in which this is only one and when there is a plurality thereof, is allowed by the intrinsic characteristics of the tissue paper, sufficiently yielding and elastic to be molded in correspondence of the pitchs which are created in the overlapping areas and to expand to adapt to the diameter greater than that of the spindle due to the subsequent overlapping of the tape.

These intrinsic characteristics of the tissue paper are further enhanced by the moisture contribution given by the application of the adhesive film 2.

It is furthermore pointed out that this technical solution for the formation of the tubular core can not be adopted either by using cardboard tapes or by using tissue tapes which consist of a large number of tissue tapes overlapped and stiffened by the application of adhesive and starch, as in the prior art cited, as for the thickness and rigidity of the tape would lead to the formation of folds and wrinkles due to the overlapping of the coils.

Figure 4:
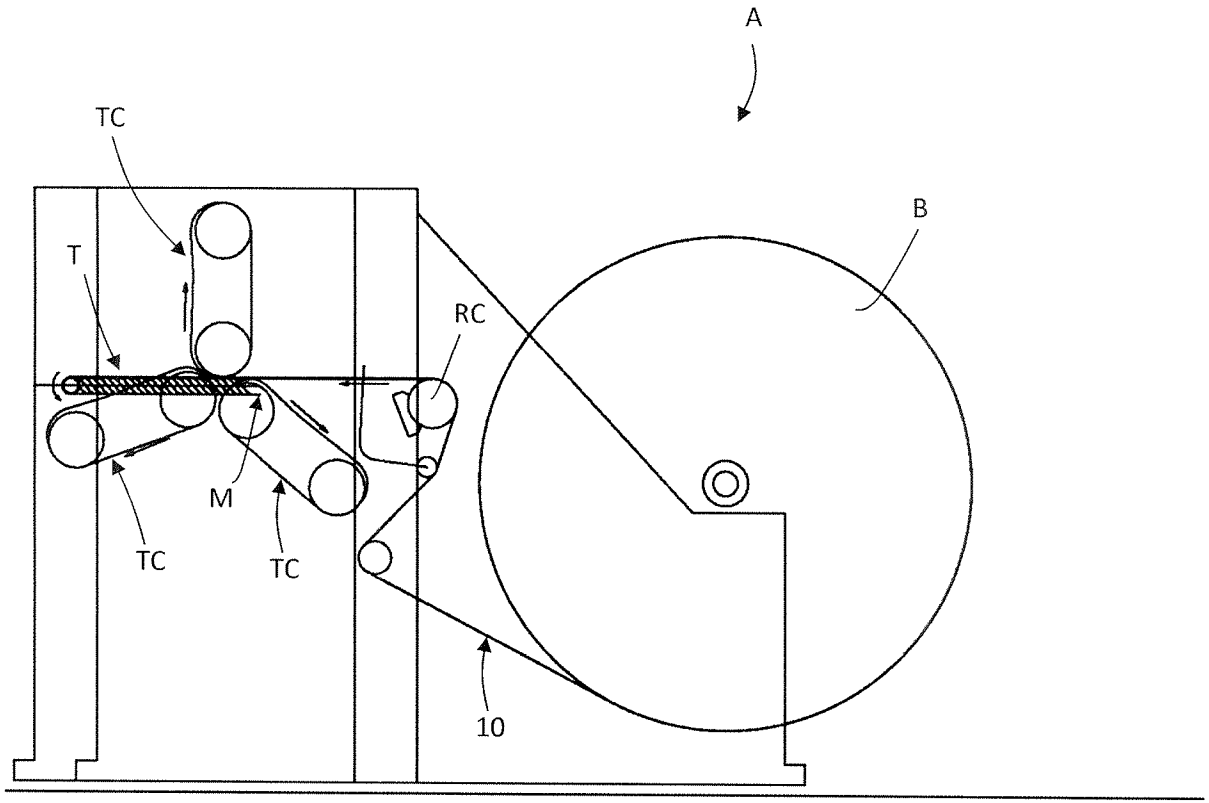
FIG. 4 shows schematically, from the side, a continuous tube-forming machine, usable for the implementation of the method.
Figure 5:
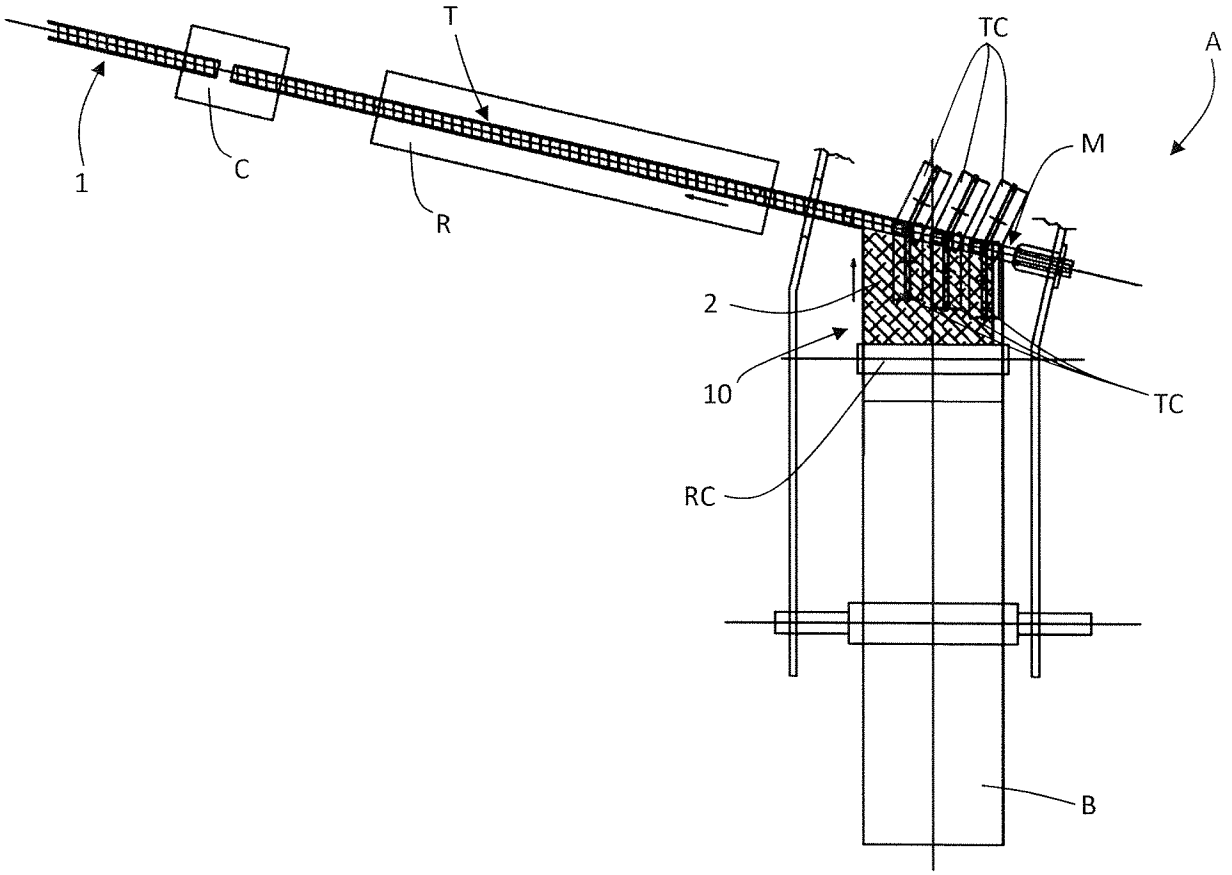
FIG. 5 shows schematically, in plan view, the machine of FIG. 5.

Otherwise, the tubular cores 1 according to the present invention as previously described, can be advantageously realized both by means of a traditional tube-forming machine modified in the sections for forming the tube and unwinding the reel, or by means of a special tube-forming machine A; schematically illustrated in FIGS. 4 and 5, specially designed for the formation of a continuous pipe T of tissue paper.

The machine A rotatably supports, with horizontal axis, a reel B of tissue paper with one or more plies, from which the said tape 10 of predetermined width is unwrapped, indicatively between a minimum of 20 cm and a maximum of about 170 cm, the tape 10 is directed towards the spindle M, mentioned above, consisting of a cylindrical shaft having a diameter equal to that of the inner of said tube T to be made.

Between the reel B and the spindle M there is an adhesive applicator roller RC, which detects the face of the tape 10 intended to be inside the winding on the spindle M, and affixes the adhesive film 2, of the expected width.

The spindle M can be arranged with its horizontal axis, like that of the reel B, but is inclined with respect to the latter, on the horizontal plane, of an angle corresponding to that of the winding helix of the coils S (see in particular, FIG. 5 in plan).

The tape 10 is then progressively wound in a helical spiral around the spindle M, with the aid of belt dragging elements, TC arranged around the spindle M, which can be fixed but also advantageously dragged in rotation either by the tissue paper itself or by a special transmission to reduce the slippage between the spindle and the internal surface of the tube to the only axial component of the motion.

The continuous pipe T in tissue paper after its formation passes from a heating element R which favors the drying of the glue previously applied on the tape and, once a predetermined length has been reached, is truncated, by means of special cutting members (schematically shown in box C in FIG. 5), from the following one in formation, so that the obtained tubular core 1 can be fed into a rewinding machine, arranged downstream and not shown, to receive the tissue paper of the roll in winding.

Usually, said rewinding machine works with a tissue paper band as wide as a certain number of times that of the final rolls, which are then obtained for subsequent longitudinal sectioning, therefore the tubular core 1 will consequently have a corresponding length, i. e. a multiple of that of each piece of tubular core 1 around which a tissue paper roll will eventually be wrapped.

According to the method provided in the present invention, which can be implemented, for example, with the tube-forming machine A above, the production of tubular cores 1 comprises the following steps:

- the unwinding of at least one tissue paper tape 10 from at least one relative reel B having the same width;
- the winding on a spindle M of the tissue paper tape 10 carried by said reel B, with this winding carried out according to a helical spiral with a pitch much smaller than the width of the tape and proportional to a submultiple of the overall width of the tape 10 so that each coil S in formation partially surmounts two or more of the preceding coils, with said coils S which slide axially with respect to said spindle M during the winding so as to form a continuous pipe T; the application of adhesive 2 on the side of said tape 10, intended to become the internal surface of a relative coil wound on the spindle M, said adhesive 2 application occurring between said unwinding from said reel B and said winding on said spindle M, said application of adhesive 2 being adapted to distribute said adhesive 2 in a substantially uniform manner on a predetermined portion of the width of said tape 10, such that upon wrapping on said spindle M said adhesive film 2 overlaps the preceding coil and does not get into contact with the outer surface of the spindle M;
- the heating of the tube thus formed in order to guarantee the drying of the layers of glue present between the various coils;
- the cutting of the continuous pipe T in formation at a length corresponding to that of said tubular core 1.

The method, in an embodiment variant, provides for the simultaneous execution of a plurality of tissue paper tapes 10 from corresponding reel B and the simultaneous winding of said plurality of tapes 10 onto the said spindle M, according to respective helical spirals preferably offset the one with respect to the other of a predetermined amount along the longitudinal axis of said tubular core 1.

In another embodiment the adhesive film 2 is provided on the outer side, with reference to the coil S wound on the spindle M, of the tape 10 and consequently the width portion at which said adhesive film is applied is modified, which in this case must be such that the subsequent coil S completely covers the adhesive film 2.

From the foregoing, the peculiar characteristics of the invention in question are clearly evident, which allows the realization of tubular cores made of tissue paper similar to that of the roll wound around them and intended for domestic or industrial use, with a method capable of forming a continuous pipe, similarly to what is realized with cardboard cores.

Another advantageous goal, achieved with the invention, consists in having eliminated the preliminary steps provided in the known art method for preparing tapes of tissue paper with a high number of plies, before starting the real forming of the tubular core, with significant savings in production costs.

The tubular cores of tissue paper which are made according to the invention have a mechanical resistance suitable for the function they have to perform, both in axial and radial direction and homogeneous in each zone thereof, thanks to the overlapping portions of the helical coils of the tapes and to the adhesive film interposed between them, so that the tissue paper rolls, with said cores of tissue paper, which the consumer finds to use, present themselves, as regards to the stability and the regularity of the form, very similar to those with the traditional cardboard core and also the producer of rolls can count on the stability of the so produced tubes to have guaranteed the necessary efficiency in the various phases of processing and storage of the rolls.

It has to be highlighted the ease with which, in the proposed invention, it is possible to modify the desired mechanical characteristics of the tubular cores in tissue paper, modifying both the pitch of the helical coils and the number of tapes in simultaneous wrapping, without this significantly modifying the production times and therefore the costs. For example, according to the present invention, in order to increase the thickness of the tubular core, it is sufficient to modify the pitch of the wrapping helix of the same tissue tape thus obtaining a greater number of overlapped coils, while with the conventional tubular tissue cores and the related realization methods it would be needed to wrap a greater number of tapes.

Having a roll with a tubular core, which is also made of tissue paper, allows a quantity of reserve product to be available, once the tissue paper roll has been used up, which can be used for similar or even different uses, compared to those of the roll paper.

In particular for rolls of toilet paper, it is possible, and without contraindications, to dispose the tubular cores, as such or used in some way, through the discharge of the toilet, like the tissue paper of the roll. Similarly, in the case of rolls of kitchen paper, a tubular core according to the invention can be unrolled and used as kitchen paper.

It is to be highlighted the high efficiency obtainable with the method of the invention since the tube is made with a machine which produces continuously at a relatively low speed and in which the paper can be fed by a reel so large in diameter and in width that, with opportune devices, can produce tubes for a whole work shift.

This reduces the need for the presence of machine responsible staff as happens with conventional tubing which produce tubular cores starting from cardboard or tissue tapes according to said known technique, in which the cardboard or tissue rolls have a duration that is so short as to require continuous change with related uploads.

Another advantage to be highlighted is the increase in the duration of the circular knives mounted in the cutting machines which section the long rolls to obtain the rolls; in fact, these tend to slip out due to the cutting of the cardboard tubes and to the impurities in these present which require continuous sharpening with consequent wear.

However, it is understood that the above description has an exemplifying and non-limiting value, therefore any variants of detail that may become necessary in the tubular tissue paper core and/or in the carrying out of the steps described, for technical and/or functional reasons, are considered since now falling within the same protective scope defined by the following claims.

The invention claimed is:

1. A tubular core designed for wrapping tissue paper rolls or other tape paper material, comprising:

- at least one tape of spiral wound tissue paper of one or more plies, so that a pitch of a winding helix is smaller than a width of the tape itself, so that in a generic section perpendicular to an axis of the tubular core is superposed a predetermined number greater than or equal to three coils of the tape are overlapped; and
- an adhesive film wound in a spiral with the tape, so as to be interposed between each pair of subsequent partially overlapping coils of the tape, the adhesive film connecting the coils and providing structural strength of the tubular core.

2. The tubular core according to claim 1, further comprising a plurality of tissue paper tapes, each spirally wound according to a helix pitch smaller than its width, and in that each tape is wound on a preceding one so that its coils are offset along a longitudinal axis of the tubular core by a predetermined amount.

3. The tubular core according to claim 1, wherein the adhesive film is continuous in a direction of the winding, and assumes, in a longitudinal development of the same tubular core, a helix spiral shape.

4. The tubular core according to claim 1, further comprising a small stripe of adhesive tape, wherein an amount of adhesive is greater than in remaining parts of the adhesive film and is placed in correspondence of a closing edge, so as to improve fastening of the same on underlying coils.

5. The tubular core according to claim 1, further comprising a plurality of mutually offset tapes, wherein the adhesive film of each tape after a first one is of a width equal to the width of the tape itself.

6. A method for the production of tubular cores for tissue paper rolls or other tape paper material, comprising the steps of:

unwinding of at least one tape of tissue paper from at least one relative reel of same width;

winding on a spindle of the tissue paper tape, with the winding performed according to a helix spiral with a pitch much smaller than a width of the tape so that each forming coil partially overlaps a previous one and in a specific section perpendicular to an axis of the core overlaps at least three coils; and applying an adhesive film on one side of the tape, the application of adhesive occurring between the unwinding from the reel and the winding on the spindle, the application of adhesive being adapted to distribute the adhesive film substantially uniformly on a predetermined portion of the width of the tape intended to overlap the previous coil or be overlapped by a subsequent coil.

7. The method according to claim 6, wherein the adhesive film is applied on a side of the tape intended to become an inner surface of a relative coil wound on the spindle, the application of the adhesive being adapted to distribute the adhesive film in a substantially uniform manner on a predetermined portion of the width of the tape such that, upon the winding on the spindle, the adhesive film overlaps to a previous coil and does not contact an outer surface of the spindle.

8. The method according to claim 6, wherein, during the winding phase, the coils slide axially with respect to the spindle so as to form a continuous pipe, a cutting phase of the forming continuous pipe is provided to cut the continuous pipe into sections of length corresponding to a length of the tubular core.

9. The method according to claim 6, wherein, before the cutting phase of the continuous pipe, there is provided a drying phase of the continuous pipe.

10. The method according to claim 6, further comprising the step of simultaneous unwinding of a plurality of tapes of tissue paper from corresponding reels and simultaneous winding of the plurality of tapes on the spindle, according to a respective helix spiral staggered one to the other by a predetermined amount, along a longitudinal axis of the tubular core.

* * * * *